US005735541A

United States Patent [19]

Fritschi et al.

[11] Patent Number: 5,735,541

[45] Date of Patent: Apr. 7, 1998

[54] SKI BINDING

[75] Inventors: Andreas Fritschi, Wimmis, Switzerland; Tilo Riedel, Fuschl, Austria

[73] Assignee: Fritschi AG Apparatebau, Reichenbach, Switzerland

[21] Appl. No.: 718,314

[22] PCT Filed: Jan. 30, 1996

[86] PCT No.: PCT/AT96/00013

§ 371 Date: Sep. 27, 1996

§ 102(e) Date: Sep. 27, 1996

[87] PCT Pub. No.: WO96/23559

PCT Pub. Date: Aug. 8, 1996

[30] Foreign Application Priority Data

Feb. 1, 1995 [AT] Austria ..... 170/95

[51] Int. Cl.[6] ..... A63L 9/08

[52] U.S. Cl. ..... 280/617; 280/633; 280/634

[58] Field of Search ..... 280/607, 617, 280/618, 623, 633, 634, 628, 629, 630

[56] References Cited

U.S. PATENT DOCUMENTS

| | | | |
|---|---|---|---|
| 4,088,342 | 5/1978 | Hausleitner . | |
| 4,134,603 | 1/1979 | Zoor . | |
| 5,360,229 | 11/1994 | Ardain et al. | 280/617 |

FOREIGN PATENT DOCUMENTS

| | | |
|---|---|---|
| 343522 | 2/1977 | Austria . |
| 376139 | 10/1984 | Austria . |
| 0031740 | 2/1984 | European Pat. Off. . |
| 2511602 | 2/1983 | France . |
| 1960489 | 6/1971 | Germany . |
| 2417892 | 10/1975 | Germany . |

OTHER PUBLICATIONS

WO 82/03182 * publ. Sep. 30, 1982.

*Primary Examiner*—Richard M. Camby
*Attorney, Agent, or Firm*—Collard & Roe, P.C.

[57] ABSTRACT

A ski binding with a front jaw (1) is described, which is connected to a rear jaw (2) by a carrier (3), the rear jaw being arranged on the carrier adjustably in the direction of the longitudinal extension thereof, and comprises a laterally pivotal device (10) for holding down the sole, the device being supported against lateral pivoting by a pressure element (13) which is displaceably mounted in the direction of the longitudinal extension of the carrier and is biased by at least one spring (14). To enable such a ski binding to be pivoted about a front transverse axis (6), it is proposed that the carrier (3), which is pivotal with the front jaw (1) about a transverse axis (6) in the range of the front jaw (1), consists of a hollow section (4), the hollow section receiving the biasing spring (14) for the pressure element (13) and the spindle (41) of a screw drive (40) for adjusting the rear jaw (2) displaceably guided on the hollow section (4).

6 Claims, 5 Drawing Sheets

SKI BINDING

Figure 1:
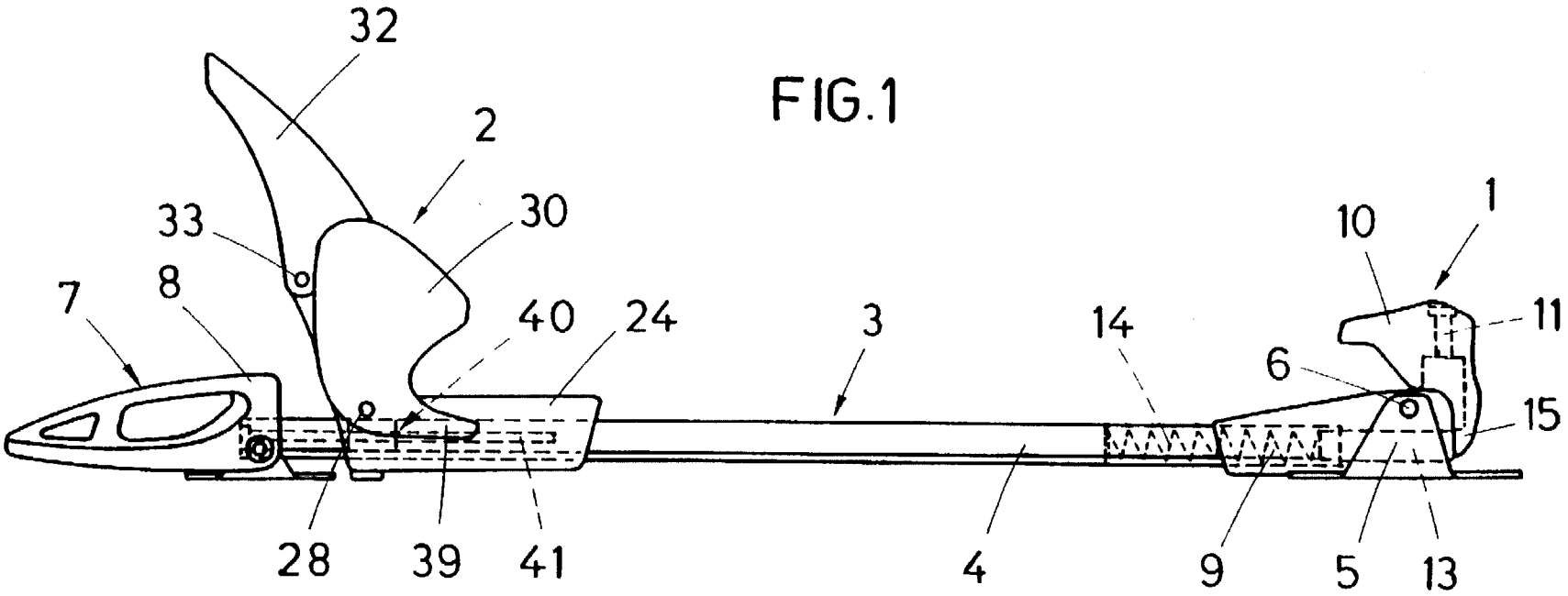

The invention relates to a ski binding with a front jaw which is connected to a rear jaw by a carrier, the rear jaw being arranged on the carrier adjustably in the direction of the longitudinal extension thereof, and comprises a laterally pivotal device for holding down the sole, the device being supported against lateral pivoting by a pressure element which is displaceably mounted in the direction of the longitudinal extension of the carrier and is biased by at least one spring.

Ski bindings in which the rear jaw is arranged on a carrier connecting the two binding jaws have the advantage that the ski boot inserted in the ski binding does not impair the flexing behavior of the ski if the carrier is stationarily affixed to the ski in the range of the front jaw. In addition, it provides the simple possibility of mounting the structural unit comprised of the carrier and the two binding jaws for pivoting about a transverse axis in the range of the front jaw to enable the boot to be lifted off the ski in the range of the heel to facilitate a walking motion, without having to detach or adjust the ski binding. For this purpose, it is only necessary to provide a releasable latch for the carrier on the ski. However, difficulties are encountered in providing advantageous devices for a safety release of the ski binding, particularly for the lateral pivotal release of the front jaw, as it is known in ski bindings with non-pivotally mounted front jaws (EP-PS 0 031 740), in which a device for holding down the sole, which is laterally pivotal about a central pivoting axis, is supported by a forwardly mounted pressure element which is displaceably mounted in a housing associated with the front jaw and is biased by a compression spring. If the device for holding down the sole is subjected to a suitable torque, the pressure element is displaced by the device for holding down the sole against the longitudinal adjustment of the rear jaw, and the spindle thereof may also be arranged in the hollow section of the carrier so that, in totality, a very compact and light construction results, which permits the transfer of all the safety features of non-pivotally positioned ski bindings to ski bindings which are pivotal about a front transverse axis.

Since the hollow section of the carrier extends underneath the sole of the ski boot, it is necessary to provide for a suitable force transmission from the device for holding down the sole at the front jaw through the pressure element to the biasing spring arranged in the hollow section. Although this may be accomplished by various structures, particularly advantageous structural conditions are obtained if, according to a preferred feature of the invention, the pressure element is displaceably mounted in the hollow section or in a guide in a front jaw housing which is an extension of the hollow section, the device for holding down the sole at the front jaw, which is laterally pivotal about a central pivot axis, comprising two entrainment lugs downwardly projecting at respective sides of the pivot axis and engaging a free front face of the pressure element. In this case, the pressure element is positioned behind the entrainment lugs so that the front jaw with the device for holding down the sole forms the front end. The operation of the safety release of the front jaw is not influenced thereby because the lateral pivoting of the device for holding down the sole depends on the displacement of the pressure element against the force of the biasing spring.

To facilitate the release of the ski boot sole, it is known (FR-PS 2 511 602) to hold the central pivot axis for the lateral pivoting of the device for holding down the sole in a lower rocker bearing so that the device for holding down the sole, which is supported by a spring-biased pressure element, may tilt force of the compression spring until the sole of the ski boot is released from the device for holding down the sole. Thus, the compression spring determines the release force for the front jaw, which may be simply adjusted by the pre-tension imparted to the compression spring. Since the housing receiving the pressure element with the compression spring is arranged forwardly of the device for holding down the sole at the front jaw, such a front jaw cannot be mounted for pivoting about a transverse axis to lift the heel because such a transverse axis must be positioned at the tip of the boot and not a distance in front of it.

Therefore, it is an object of the invention to improve a ski binding of the first-described type with simple structural means so that the structural unit comprised of the two binding jaws and the carrier is enabled to pivot about a transverse axis in the range of the front jaw, and this with a low weight of the binding.

The invention accomplishes this object with a carrier consisting of a hollow section which is pivotal with the front jaw about a transverse axis in the range of the front jaw, the hollow section receiving the biasing spring for the pressure element and the spindle of a screw drive for adjusting the rear jaw displaceably guided on the hollow section.

The formation of the carrier connecting the binding jaws as a hollow section enables the biasing spring for the pressure element to be accommodated in this hollow section, which does away with a complex front jaw housing projecting towards the tip of the ski beyond the device for holding down the sole so that it is simple to provide a pivot bearing of the front jaw with the carrier about a transverse axis at the tip of the boot. Furthermore, a screw drive may be provided for the required about a transverse axis when subjected to a predetermined load and may thus release the ski boot. If, according to the invention, the device for holding down the sole is pivotal about a transverse axis constituted by a head of the pivot axis thereof, the device being supported by a cam of the front jaw housing spaced vertically from this head and controlling the pivotal movement of the device for holding down the sole about the transverse axis in dependence on the angle of the lateral pivoting movement, a similar tilting movement may be obtained for the device for holding down the sole but with the advantage of an automatic control of this tilting movement during the lateral pivoting of the device for holding down the sole because the device for holding down the sole is positioned by the cam at the lateral pivoting at a distance from the head of the pivot axis to this axis, which causes the desired tilting movement of the device for holding down the sole about the head of the pivot axis.

The rear jaw is adjustably positioned on the hollow section of the carrier by means of a self-restraining screw drive to adjust the distance between the binding jaws. Preferably, the spindle of the screw drive is held in the hollow section against axial displacement, and the nut thereof, which is associated with the rear jaw, is guided in the hollow section while held against rotation to avoid relative displacements between the hollow section and the spindle which may increase the length of the binding. If the screw drive for adjusting the rear jaw displaceably mounted on the hollow section is repositionably held in the hollow section between the jaws against spring bias in the direction of an increase in the distance, the pressure force of the rear jaw against the ski boot can be set by a spring force substantially independently of the adjustment of the screw drive and an adaptation to changing sole lengths due, for example, to snow accretions may be obtained.

The safety release of the rear jaw may be obtained in different ways. A preferred embodiment, however, is characterized by a rear jaw which comprises a device for holding down the sole which is vertically adjustable in a guide of the rear jaw housing and is pivotal about a transverse axis, which is supported by an entrainment abutment of an actuating lever which is mounted for pivoting about a transverse axis on the rear jaw housing, and which may be raised by the actuating lever against the force of at least one spring arranged in the rear jaw housing from a locking position to an open position. The device for holding down the sole is pressed by the spring in the rear jaw housing into the locking position. Therefore, the device for holding down the sole must be raised against this spring force to release the rear jaw, either by the ski boot sole or by the actuating lever. In both cases, the raising motion may be combined with a pivoting movement of the device for holding down the sole to facilitate getting out of, and into, the binding. The device for holding down the sole is pivotal about a transverse axis with respect to the rear jaw housing and is supported by an entrainment abutment of the actuating lever, whose rotary motion initiates a pivoting movement of the device for holding down the sole by the entrainment abutment. In this connection, it may be advantageous if the device for holding down the sole of the rear jaw housing forms two vertically sequential glide supports for the rear jaw housing, which are angularly staggered from each other with respect to the transverse axis of the device. One of these glide supports prevents a premature pivotal movement of the device for holding down the sole while the other glide support determines the end position of the opened device for holding down the sole and must, therefore, be suitably angularly staggered from the one glide support. A displacement movement of the device for holding down the sole alone causes, of course, a corresponding relative movement of the entrainment abutment of the actuating lever with respect to the device for holding down the sole, which may be structurally realized very simply by a suitable shape of the abutment of the device for holding down the sole cooperating with the entrainment abutment. Furthermore, the shoulder between the two glide supports may be utilized for holding the device for holding down the sole in its open position if the rear jaw housing forms a corresponding detent against which the shoulder is pulled by the spring biasing the device for holding down the sole in the direction of the locking position. If the device for holding down the sole comprises locking lugs laterally adjacent the hollow section of the carrier, which project into the path of movement of the sole of the boot in the open position of the device for holding down the sole when getting into the ski binding, the rear jaw will be locked automatically because the rear jaw is entrained from the open position by the ski boot through the locking lugs until the locking spring becomes effective and presses the device for holding down the sole into the locking position.

The drawing illustrates the subject matter of the invention by way of example. Shown is in FIG. 1 a schematic side elevational view of a ski binding according to the invention, FIG. 2 a schematic longitudinal section of the front jaw of this ski binding, on an enlarged scale, FIG. 3 a section along line III—III of FIG. 2, FIG. 4 a section along line IV—IV of FIG. 2, FIG. 5 a section long line V—V of FIG. 2, FIG. 6 the rear jaw of the ski binding in a schematic longitudinal section, on an enlarged scale, and FIG. 7 the rear jaw in a side elevational view, partly broken away.

Figures 4, 5:
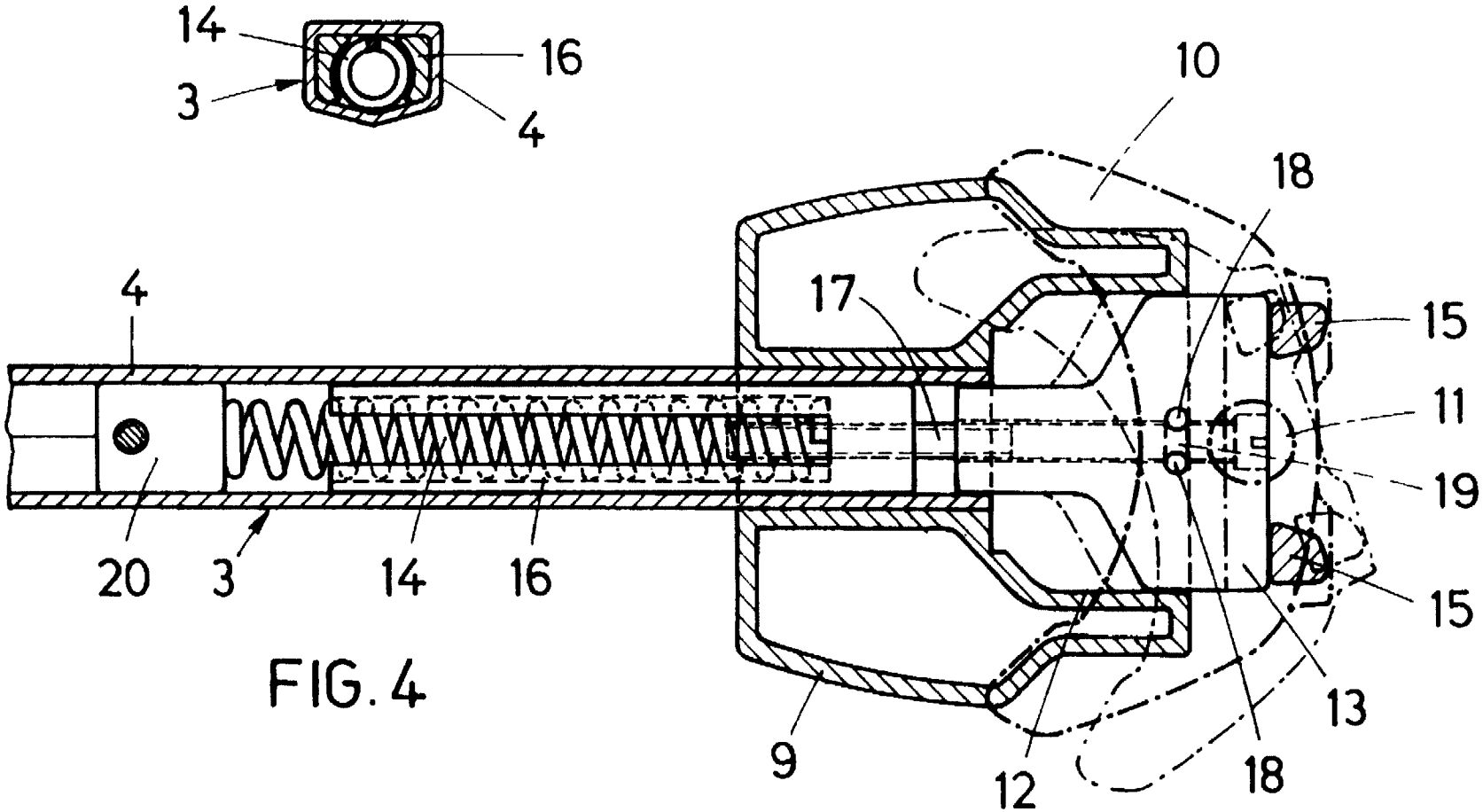

According to FIG. 1, the illustrated ski binding comprises a front jaw 1, a rear jaw 2 and a carrier 3 connecting the two binding jaws 1 and 2, the carrier being constituted by hollow section 4, for example of substantially rectangular cross section but with a V-shaped bottom, as can be seen in FIG. 5. The structural unit formed by carrier 3 and the two binding jaws; 1, 2 is mounted in bearing 5 for pivoting about transverse axis 6 in the range of front jaw 1 and may be held in the illustrated base position by a locking device 7. This locking device 7 encompasses an end piece of hollow section 4 which extends beyond rear jaw 2 by means of locking lever 8 which must be upwardly pivoted for unlocking hollow section 4. At the same time, this locking lever 8 may produce supports for hollow section 4 at different heights to form entering assistance in different pivotal positions.

Figure 2:
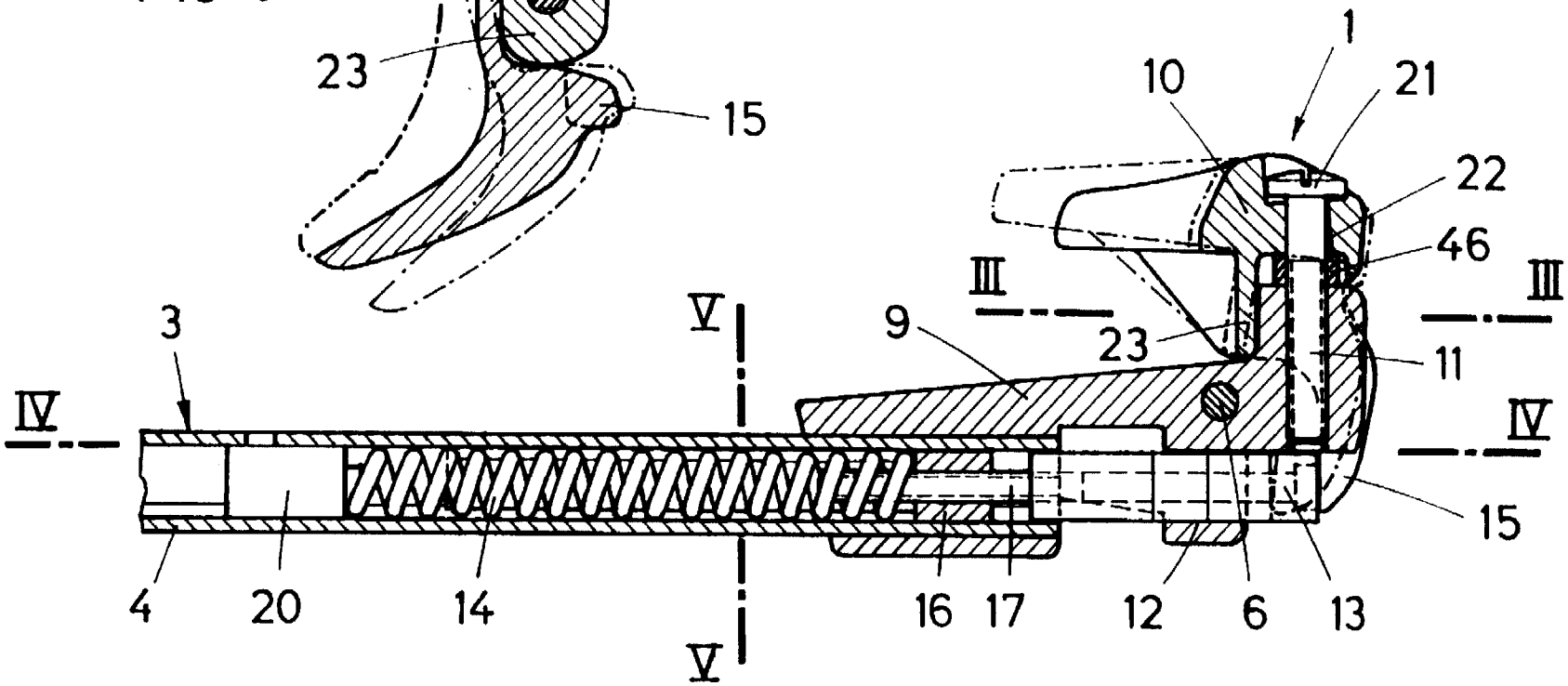
Figure 3:
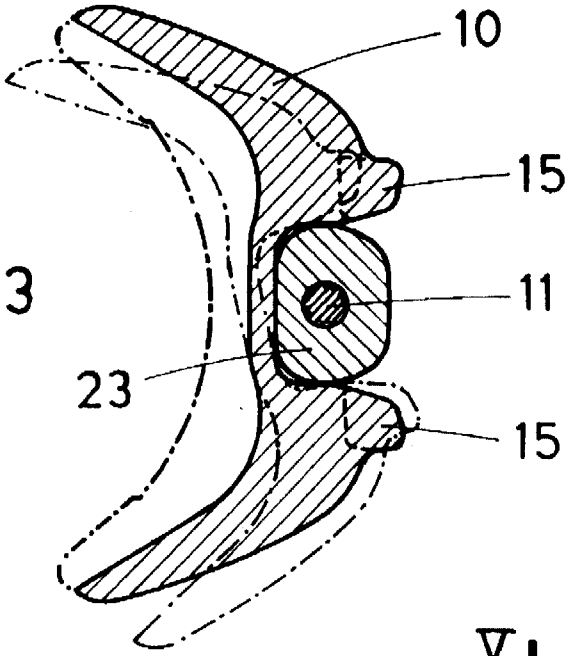

The structure of front jaw 1 is shown in detail in FIGS. 2 to 4. It is comprised essentially of a housing 9 providing support for the sole, with which a laterally repositionable sole plate may be associated, and a device 10 for holding down the sole, which is mounted on housing 9 for lateral pivoting about central pivot axle 11. Hollow section 4 of carrier 3 is held against displacement in a receiving opening of housing 9, and in an extension thereof, housing 9 defines a displacement guide 12 for a substantially T-shaped pressure element 13 which projects into hollow section 4 and is biased by compression spring 14 arranged in hollow section 4. This biasing spring 14 presses an end face of pressure element 13 against downwardly projecting entrainment lugs 15 of device 10 for holding down the sole. Since entrainment lugs 15 extend substantially parallel to pivot axle 11 at both sides thereof, device 10 for holding down the sole is held in a centered position by pressure element 13. To pivot device 10 for holding down the sole laterally about pivot axle 11, pressure element 13 is pushed by one of the entrainment lugs 15 against the force of biasing spring 14 into guide 12, as is shown in phantom lines in FIG. 4. In this way, biasing spring 14 determines the release force for the safety release of front jaw 1. To enable the release force to be adapted to prevailing conditions, biasing spring 14 is encased in spring sleeve 16 which is adjustable with respect to pressure element 13 by a threaded connection. For this purpose, spring sleeve 16 is displaceably held in hollow section 4 but is non-rotatable because it has an outer transverse section conforming to the transverse section of hollow section 4, and it is repositioned relative to pressure element 13 by means of an adjustment screw 17 engaging a threaded nut of spring sleeve 16 and mounted non-displaceably but rotatably in pressure element 13. Fixing pins 18 engaging an annular groove 19 in adjustment screw 17 secure adjustment screw 17 against displacement. Since biasing spring 14 extends between fixed abutment 20 in hollow section 4 and spring sleeve 16, the pre-tension of biasing spring 14 and thus the release force for the lateral pivoting of device 10 for holding down the sole is adjusted by readjusting adjustment screw 17.

As can be seen from FIG. 2, device 10 for holding down the sole is upwardly tiltably mounted on front jaw housing 9 in the range of head 21 of pivot axle 11, due to a conically downwardly widening of bore 22 for pivot axle 11. This tilting movement, however, is controlled in dependence on the lateral pivoting angle because the part of the housing receiving pivot axle 11 and projecting towards device 10 for holding down the sole forms a cam 23 which, as the lateral pivoting angle of device 10 for holding down the sole increases, forces removal thereof from pivot axle 11. Since this is effected at a distance from head 21 of pivot axle 11, device 10 for holding down the sole is tilted upwardly about head 21 serving as a tilting axis from the base position shown in full lines in FIG. 2 into the position shown in phantom lines, which corresponds to the pivoted position of the device 10 for holding down the sole showing in phantom lines in FIG. 3. However, device 10 for holding down the sole may be tilted upwardly in the base position despite the forced removal during the lateral pivoting against the force of biasing spring 14, which assures an advantageous elastic engagement with the ski boot sole, for example to compensate for snow accretions on the boot sole.

Figure 7:
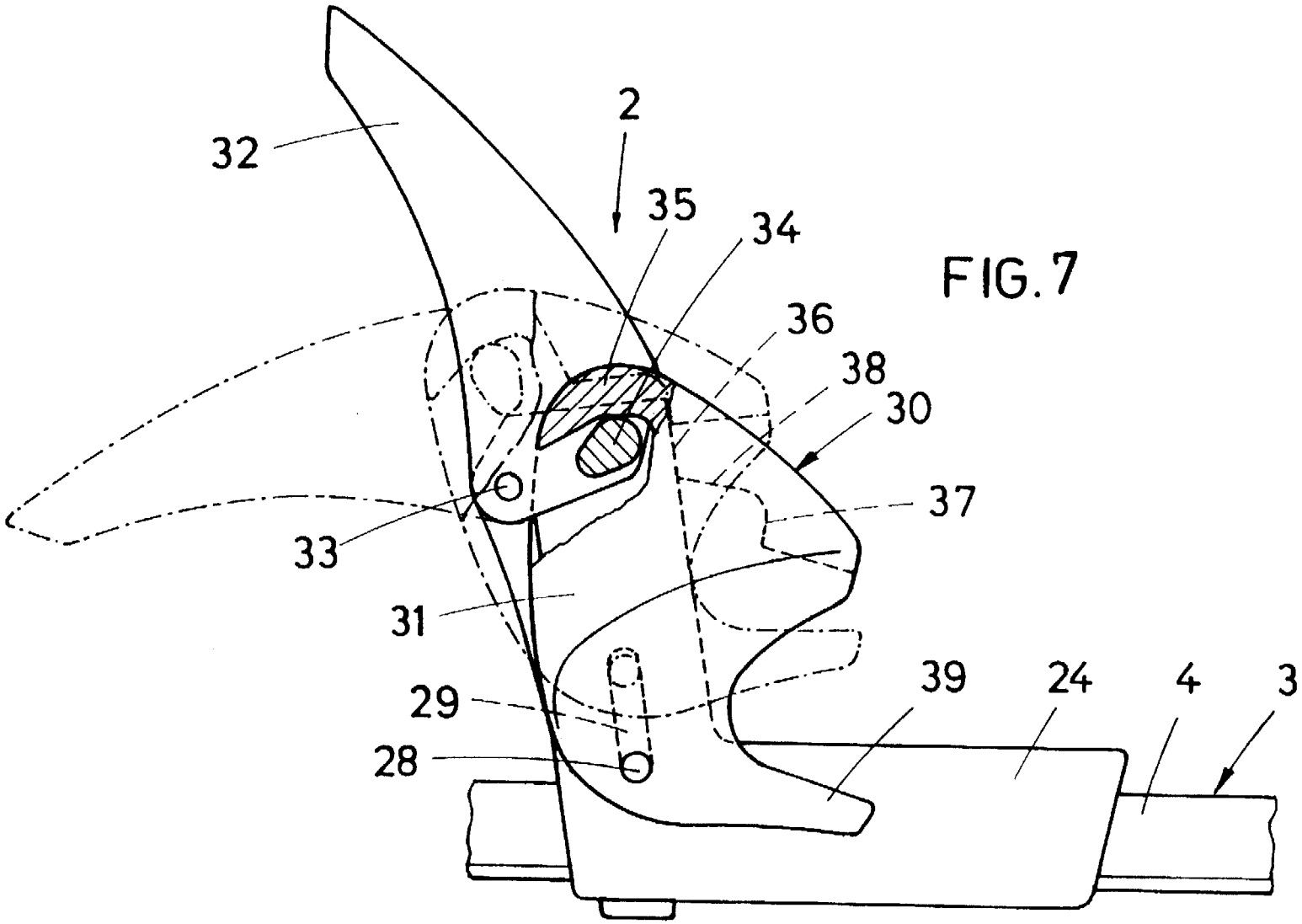

Rear jaw 2 comprises a substantially L-shaped housing 24 one of whose legs defines a displacement guide 25 into which hollow section 4 of carrier 3 extends. The other housing part rising from carrier 3 receives a compression spring 26 which is supported by guide piece 27 on a transverse axle 28. This is displaceably guided in guide 29 of housing 24, which is defined by an elongated slot, and forms the lower bearing for a device 30 for holding down the sole, which surrounds the rising housing part with lateral cheeks 31. The upper support for device 30 for holding down the sole is constituted by actuating lever 32 which is linked to housing 24 by pivot pin 33 and which comprises entrainment lugs 34 between housing 24 and lateral cheeks 31 of device 30 for holding down the sole. These entrainment lugs are engaged by abutments 35 on lateral cheeks 31 of device 30 for holding down the sole, which overlap entrainment lugs 34, as can be seen in FIG. 7. In the closing position of rear jaw 2 shown in full lines, device 30 for holding down the sole is pressed down by compression spring 26 acting as closing spring, while the actuating lever is held in its upwardly pivoted closing position. To open the rear jaw, device 30 for holding down the sole must be raised against the force of closing spring 26, either by a boot or actuating lever 32. For this purpose, device 10 for holding down the sole is first supported by gliding portion 36 on housing 24 until this gliding support 36 at the upper end of the upright housing part enables device 10 for holding down the sole to pivot about lower transverse axle 28. This pivoting movement is limited by a further gliding support 37 which is angularly staggered from gliding support 36. The pivoting movement of device 30 for holding down the sole and the rotary motion of actuating lever 32 connected therewith is illustrated in FIG. 7. This also shows that shoulder 38 between the two angularly staggered gliding supports 36 and 37 may be utilized as a detent for the open position of device 10 for holding down the sole if housing 24 forms a suitable counter-detent against which device 30 for holding down the sole is pulled into the closed position by compression spring 26.

Since closing extensions 39 of lateral cheeks 31 project into the path of movement of a ski boot to be inserted into the ski binding in the open position of device 30 for holding down the sole, indicated in phantom lines in FIG. 7, device 30 for holding down the sole is pulled from its rest position over the ski boot until closing spring 26 becomes effective and provides for a proper closing of the binding. At the same time, actuating lever 32 is entrained into the closing position by abutments 35 of device 30 for holding down the sole.

To fit the ski binding to respective shoe sizes, rear jaw 2 must be adjusted along carrier 3. According to FIG. 6, this is effectuated by screw drive 40 whose spindle 41 projects into hollow section 4 and engages threaded nut 42 guided therein and which is connected with rear jaw housing 24 against displacement with respect thereto. Since threaded spindle 41 is correspondingly supported against displacement with respect to hollow section 4, rear jaw 2 is adjusted thereby.

Figure 6:
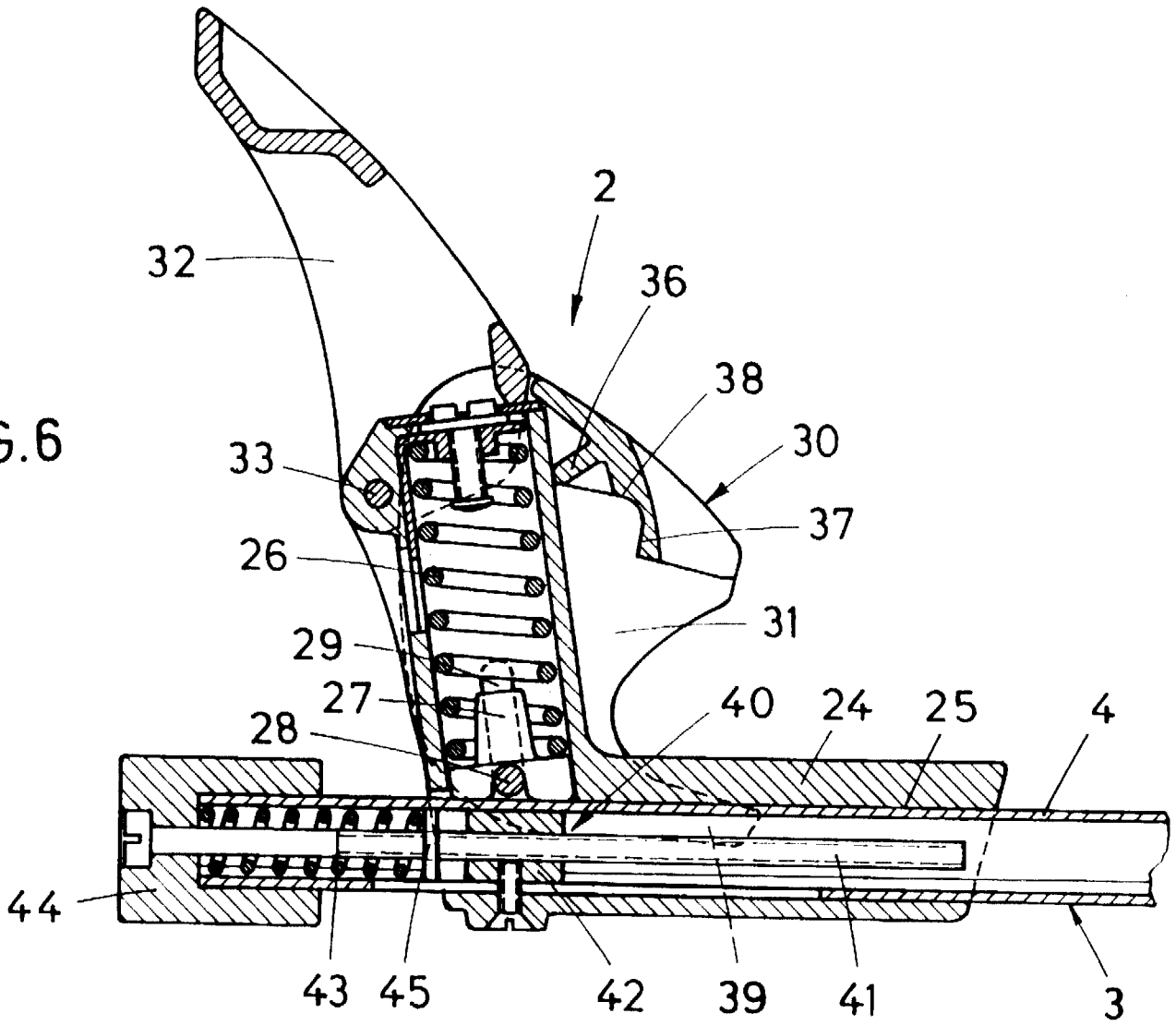

As can be seen in FIG. 6, however, threaded spindle 41 is supported against displacement by spring 43 which is supported, on the one hand, by an end piece 44 of hollow section 4, through which threaded spindle 41 passes, and on the other hand, by an abutment 45 on threaded spindle 41. In this way, threaded spindle 41 with rear jaw 2 can be displaced in a direction increasing the distance between the binding jaws against the force of spring 43. In this manner, a yielding engagement of rear jaw 2 with the boot and a tolerance-free reception of the boot in the binding can be secured.

It is not absolutely necessary to open the binding manually by actuating lever 32. Pressure element 13 of front jaw 1, which is accessible from the front, permits a release of device 10 for holding down the sole by displacing the pressure element against the force of biasing spring 14 so that the boot may be pivoted out of the front jaw without having to overcome any other release force. The displacement of pressure element 13 could be effectuated by a lever positioned in front of the front jaw and being operable by a relatively small force. Of course, such an additional adjustment drive for pressure element 13 must not interfere with its actuation by entrainment lugs 15 of device 10 for holding down the sole.

To enable device 10 of front jaw 1 for holding down the sole to be adjustable to the thickness of respective ski boots, pivot axle 11 is preferably an adjustment screw. To equalize the height, however, an elastic compensation body 46 is to be arranged between device 10 for holding down the sole and housing 9.

We claim:

1. Ski binding with a front jaw (1) which is connected to a rear jaw (2) by a carrier (3), the rear jaw being arranged on the carrier adjustably in the direction of the longitudinal extension thereof, and comprises a laterally pivotal device (10) for holding down the sole, the device being supported against lateral pivoting by a pressure element (13) which is displaceably mounted in the direction of the longitudinal extension of the carrier and is biased by at least one spring (14), characterized in that the carrier (3), which is pivotal with the front jaw (1) about a transverse axis (6) in the range of the front jaw (1), consists of a hollow section (4), the hollow section receiving the biasing spring (14) for the pressure element (13) and the spindle (41) of a screw drive (40) for adjusting the rear jaw (2) displaceably guided on the hollow section (4).

2. Ski binding according to claim 1, characterized in that the pressure element (13) is displaceably mounted in the hollow section (4) or in a guide (12) of a front jaw housing (9), which is an extension of the hollow section, and that the device (10) of the front jaw (1) for holding down the sole, which is laterally pivotal about a central pivot axle (11), comprises two downwardly projecting entrainment lugs (15) at respective sides of the pivot axle (11) and engaging a free end face of the pressure element (13).

3. Ski binding according to claim 2, characterized in that the device (10) for holding down the sole is tiltable about a transverse axis constituted by an upper head (21) of the pivot axle (11) thereof and is supported at a vertical distance from the head (21) by a cam (23) of the front jaw housing (9), the cam controlling the tilting movement of the device (10) for holding down the sole about the transverse axis in dependence on the lateral pivoting angle.

4. Ski binding according to claim 1, characterized in that the screw drive (40) for adjusting the rear jaw (2) displaceably guided on the hollow section (4) is repositionable in the hollow section (4) against spring force in a direction increasing the distance between the two binding jaws (1, 2).

5. Ski binding according to claim 1, characterized in that the rear jaw (2) comprises a device (30) for holding down the sole which is vertically adjustable in a guide (29) of a rear jaw housing (24) and is pivotal about a transverse axis (28), which is supported by an entrainment abutment (34) of an actuating lever (32) mounted pivotally about a transverse axis (33) on rear jaw housing (24) and which may be raised by the actuating lever (32) against the force of at least one spring (26) arranged in the rear jaw housing (24) from a closing position to an open position.

6. Ski binding according to claim 5, characterized in that the device (30) of the rear jaw (2) for holding down the sole forms two vertically sequential gliding supports (36, 37) for the rear jaw housing (24) which are angularly staggered from each other with respect to the transverse axis (28) of the device (30) for holding down the sole.

* * * * *